United States Patent [19]

Williams

[11] Patent Number: 4,524,917

[45] Date of Patent: Jun. 25, 1985

[54] AIR SEAL AND LUBRICATION SYSTEM FOR ROLLER GRINDING MILLS

[75] Inventor: Robert M. Williams, Ladue, Mo.

[73] Assignee: Williams Patent Crusher and Pulverizer Company, St. Louis, Mo.

[21] Appl. No.: 471,701

[22] Filed: Mar. 3, 1983

[51] Int. Cl.[3] ..... B02C 15/04

[52] U.S. Cl. ..... 241/101.2; 241/124; 241/129

[58] Field of Search ..... 241/107-133, 241/31, 101.2; 384/479, 489; 277/3, 205

[56] References Cited

U.S. PATENT DOCUMENTS

| | | | |
|---|---|---|---|
| 557,529 | 3/1896 | Holland | 241/132 |
| 2,610,802 | 9/1952 | McIlvaine | 241/133 X |
| 2,909,330 | 10/1959 | Hardinge | 241/118 X |
| 3,337,142 | 8/1967 | Williams | 241/130 |
| 4,022,387 | 5/1977 | Williams | 241/130 |
| 4,168,807 | 9/1979 | Dibowski et al. | 241/117 X |
| 4,420,064 | 12/1983 | Lohnherr et al. | 241/110 X |

*Primary Examiner*—Mark Rosenbaum
*Assistant Examiner*—Timothy V. Eley
*Attorney, Agent, or Firm*—Gravely, Lieder & Woodruff

[57] ABSTRACT

A roller grinding mill having the grinding roll assemblies pivotally suspended from a frame rotated by a drive shaft, means supplying lubricant and pressure air to the internal structure of the mill for providing primary air seals to keep abrasive matter from working into the bearings with pressurizing the lubricant to provide a source of air internally of the grinding roll assemblies to set up a secondary air seal in the event of a break or leak in the pressure air which can interrupt the primary air seal, and means to monitor or detect a condition in the mill which would result in damage to the bearings if not attended to.

8 Claims, 3 Drawing Figures

AIR SEAL AND LUBRICATION SYSTEM FOR ROLLER GRINDING MILLS

BACKGROUND OF THE INVENTION

1. Field of the Invention

This invention relates to improvements in roller grinders provided with a combination air seal and lubrication system.

2. Description of the Prior Art

It is commonly accepted that pulverizer or roller type grinding apparatus handles materials which upon being reduced create a condition in the pulverizing chamber in which the air is filled with particles thrown about at sufficient velocity to work into the moving parts of the apparatus and accelerate wear. This is especially true of roller grinders in which the grinding rolls must roll freely on the bull ring if proper reduction of the material is to be achieved. Should the particles filling the pulverizing chamber be particularly abrasive, the bearings wear rapidly and cause the grinding rolls to stick or freeze so that the rolls wear in flat spots and reduce the normal output.

The general character of roller grinding apparatus which is related to the present invention is disclosed in the prior patents of Williams U.S. Pat. Nos. 3,337,142 of Aug. 22, 1967, and 4,022,387 of May 10, 1977. Neither of these patents have disclosed any provisions for protecting the bearings. It is of course understood that air sealing of bearings and lubricant means have been utilized in separate systems which do not allow for indicating the on-set of bearing failure or actual bearing failure. When bearing failure does occur, the apparatus must be shut down quickly and dismantled for repair. This shut down event takes an expensive piece of equipment out of production and on occasions replacement parts are not readily at hand to resume productivity.

The problem in roller grinding apparatus is in finding a way of monitoring the bearings for wear and failure of lubrication and seals for the bearings, and determining the on-set of failure. As pointed out the critical bearings are associated with rapidly rotating components and in an atmosphere highly charged with dust, dirt and abrasive particles.

BRIEF DESCRIPTION OF THE INVENTION

The roller grinding apparatus depicted in the accompanying drawings illustrates unique and important improvements in the establishment and maintenance of air seals and lubrication supply systems so as to overcome the indicated problems in prior art apparatus of like character.

In a preferred arrangement air under pressure is delivered to a rotary union where both air under pressure and lubrication can be delivered to the rotation system of the apparatus. The lubrication system is composed of the delivery of lubricant to a distribution reservoir where the lubricant is subjected to centrifugal force which forces flow through the distribution conduits sufficiently rapidly for penetrating the bearing and running parts requiring constant lubrication. It is also a unique feature of the present invention to distribute air under pressure to various operating assemblies so as to form air seals to keep out dust and abrasive material, and at the same time to expose the lubricant in the distribution reservoir to air under pressure for assisting in the forceful distribution of the lubricant.

The present invention is best embodied in a roller grinder and pulverizer combination with air seal and lubrication system for the bearings where the pulverizer has a drive shaft mounted by bearings in a stationary pylon and a plurality of roller grinder assemblies mounted in bearings supported from the drive shaft for orbiting movement in a pulverizing chamber, and an air seal and lubrication system having a source of air under pressure and a separate source of lubricant, separate conduit means bringing the air and lubricant into the pulverizer, air distribution means connected into the source of air and into the roller grinder assemblies for creating air seals therefore, lubricant distribution means connected into the source of lubricant and into the bearings, and means for supplying air into the lubricant distribution means for pressurizing the lubricant in its distribution. The embodiment comprises means responsive to the movement of the air from the source to detect the on-set of bearing wear and failure of the lubricating system to provide for adequate lubrication of the bearings.

The roller grinder assemblies operate in an atmosphere that has a concentration of abrasive material which can work into the bearings and develop premature wear and early failure. The present invention is directed to means for supplying air and lubricant under pressure to the roller grinding assemblies in such manner that the air is introduced to effectively prevent entry of abrasive material, and lubricant is introduced to the bearings for proper lubrication. Should the air or lubricant conduits rupture or get pinched off the bearings will continue to be lubricated and means is provided to visually or audibly reveal that the air or lubricant has been affected by an increase in the flow of air.

BRIEF DESCRIPTION OF THE DRAWINGS

The present invention is disclosed in the accompanying drawings in certain embodiments which will serve to illustrate features of interest, wherein.

DESCRIPTION OF THE EMBODIMENTS

Figure 1:
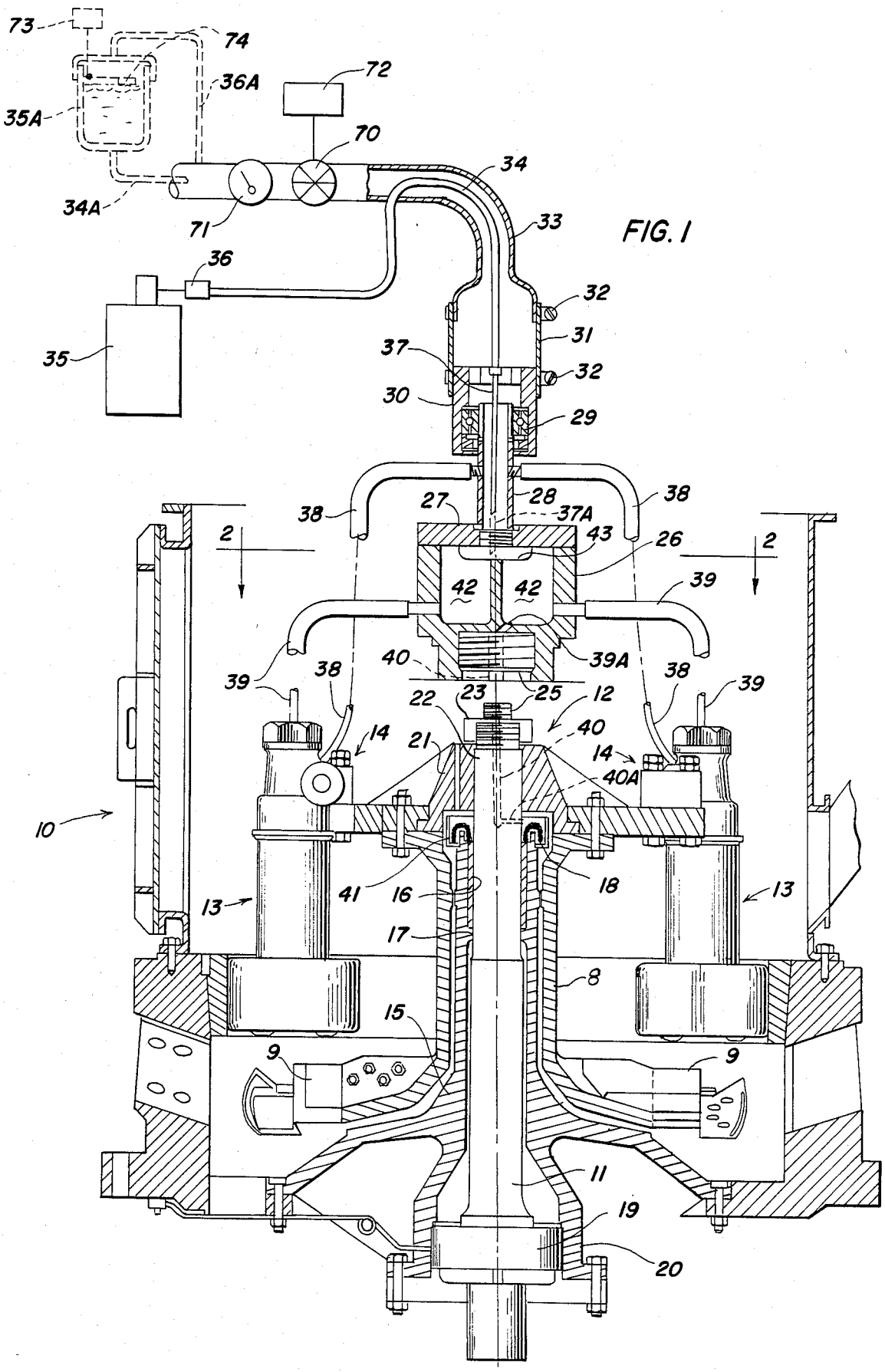
FIG. 1 is a vertical section of a roller mill in which the arrangement of air seal and lubricant system is depicted.

The present invention is arranged (FIG. 1) in combination with the usual components of a roller grinding mill 10 having a central drive shaft 11 carrying a support or head assembly 12 on which are pivotally suspended a plurality of grinding roll assemblies 13, each one being attached to the head assembly 12 by a suitable pivot forming suspension. The center drive shaft 11 extends through a stationary pylon 15 which is formed with bushing 16, an "O" ring 17 and a top lubricant reservoir 18. The pylon 15 also provides the mounting for a suitable bearing 19 adjacent the base 20 of the pylon. The support or head assembly 12 has its hub 21 set down over the upper end 22 of the drive shaft 11 and is held in position by a retainer nut 23 threaded into position. The head assembly 12 also furnishes support for a tubular sleeve 8 which carries plow means 9 at its lower end. In the foregoing arrangement, the pylon 15 and the lubricant reservoir 18, and other attachments are fixed to the mill frame and are non-rotatable components.

The disclosure in FIG. 1 includes the means by which air and lubricant can be introduced through a rotary assembly. The drive shaft end 22 is formed with a threaded extension 25 above the nut 23 so that a lubricant distribution reservoir 26 can be attached to rotate with the drive shaft 11. The reservoir cover 27 receives the threaded end of a tubular column 28 having a suitable sealed bearing 29 at its upper end to carry a non-rotating housing 30. The housing is connected by a flexible coupler 31 secured by clamps 32 to a conduit 33 which supplies air normally under about 15 psi from a suitable source (not shown). The conduit 33 forms a suitable passage for a lubricant supply conduit 34 which is connected into a lubricant supply delivered by a pump 35 feeding a metering device 36 which releases lubricant in short duration intervals into the conduit 34. The device 36 operates to deliver lubricant in predetermined quantity, as explained in Robson U.S. Pat. No. 3,074,509 of Jan. 22, 1963 and available from Trabon Engineering Corporation, and incorporated herein by reference to said patent. The lubricant from conduit 34 flows through the outlet 37 into the reservoir 26 for distribution, as will be described presently. The column 28 forms a distribution means for pressure air from conduit 33. Column 28 opens into the reservoir 26 so lubricant distributed therefrom is under pressure. Column 28 functions primarily to distribute air to lines or tubes 38 to feed pressure air to form primary air seals in the grinding roll assemblies 13. Lubricant reservoir 26 has distribution lines or tubes 39 to feed lubricant into the respective grinding roll assemblies 13. Reservoir 26 has a bottom port 39A connected into a passage 40 formed in shaft 11 to conduct lubricant to a second reservoir 18 by way of a radially directed branch passage 40A. Thus, lubricant reaches the wicking 41 to transfer the lubricant to the shaft bushing 16.

Figure 2:
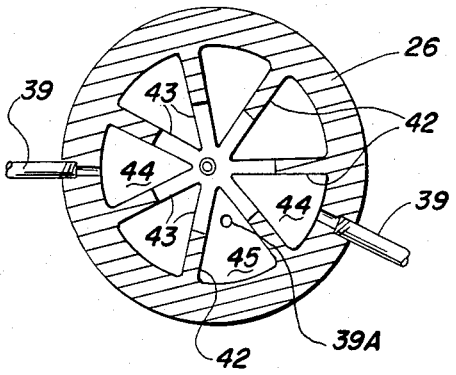
FIG. 2 is a transverse view in section, taken along line 2—2 in FIG. 1.

In FIG. 2, it can be seen that the lubricant reservoir 26 is formed with partitions 42 which are cut away along a portion of the top margin at 43 so that lubricant is in communication between spaces divided off by the partitions. The lubricant outlet 37 supplies lubricant into the reservoir 26 so that it will be distributed by centrifugal force due to reservoir rotation which forces the lubricant to flow to the outside. The reservoir 26 has pockets 44 for distribution tubes 39 and a pocket 45 for port 39A.

Figure 3:
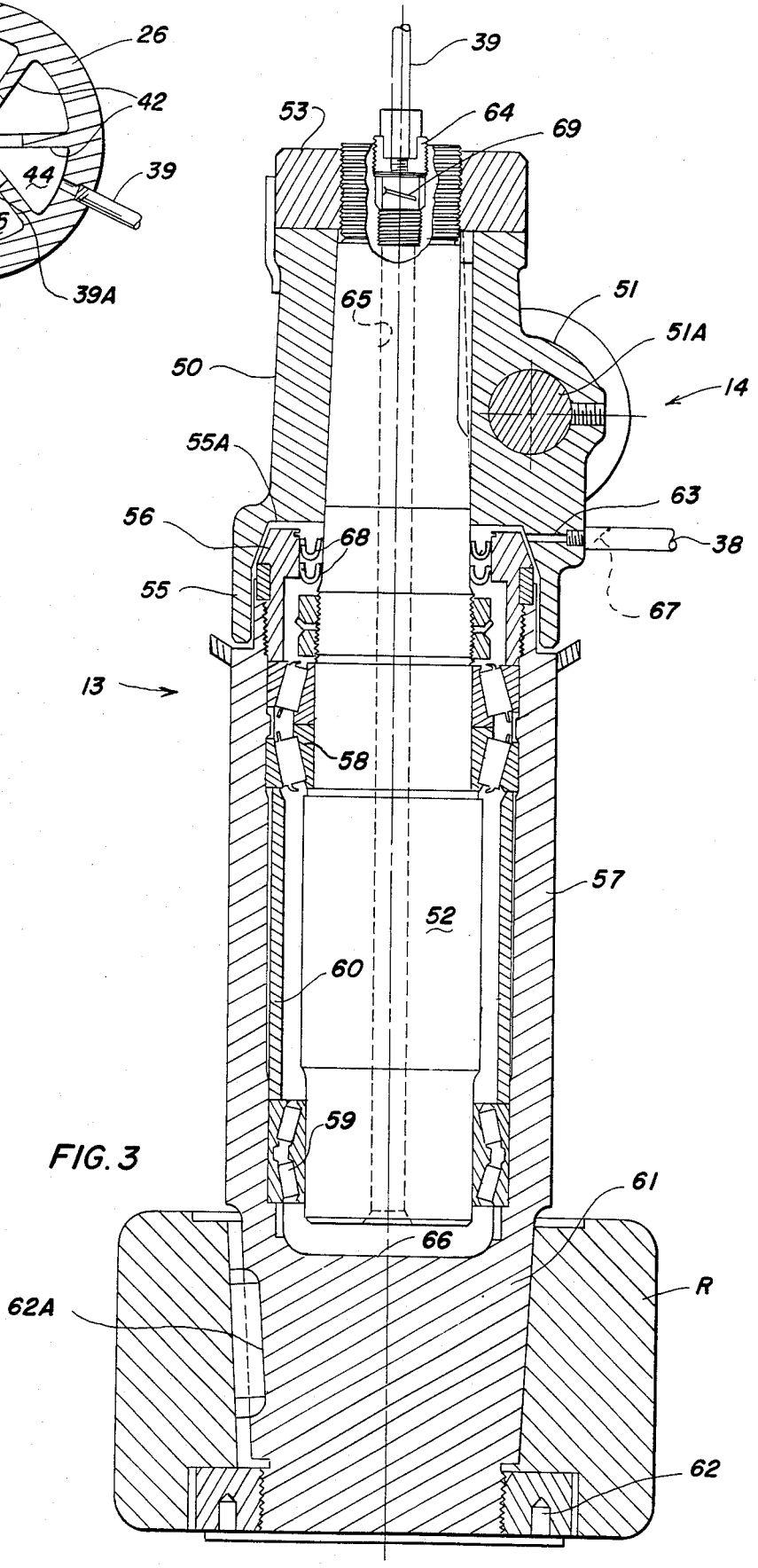
FIG. 3 is a sectional view of one roller mounting assembly which is typical of all such assemblies.

Turning now to FIG. 3, the mounting means or frame for a typical grinding roller assembly 13 is made up of cap 50 formed with an enlargement 51 to receive the pivot shaft 51A. A journal shaft 52 is mounted in cap 50 to be held by a top nut 53 threaded onto the end of journal shaft 52. The cap 50 is formed with an enlargement 55 for the purpose of receiving a suitable bearing seal assembly 56 at the top end of an outer sleeve 57 which is rotatably mounted on the journal shaft 52 by means of suitable tapered bearings 58 adjacent the seal 56 and other tapered bearings 59 adjacent the lower end of the journal 52, and spaced by the inner sleeve 60. The rotatable outer sleeve 57 is formed with a bottom tapered extension 61 which receives the grinding roller R, secured in position by a lock nut 62 and a key 62A. The upper end of the rotatable sleeve 57 has an operating clearance at the lower margin of the internal shoulder within the enlargement 55 on the cap 50. The enlargement 55 is formed with a passage 63 directed toward the journal which admits pressure air received from the air tube 38 previously identified in FIG. 1. The air thus supplied forms a primary air seal around the upper end of journal seal assembly 56 so as to substantially prevent the inward movement of dirt and abrasive material or the outward flow of lubricant.

The stationary journal 52 is formed at its upper end near the nut 53 with an apertured plug 64 for the connection of a lubricant conveying distribution tube 39. The plug 64 has a drilled passage aligned with a longitudinal bore 65 which extends downwardly through the journal 52 and is open at the bottom in a cavity or space 66 where the lubricant can reverse its flow and travel upwardly around the journal 52 for the lubrication of the lower tapered assembly bearings 59 and the upper tapered assembly bearings 58. Thus, the principal bearings for the operation of the grinding roller and its sleeve 57 can be adequately lubricated at all times. This arrangement of components plays an important part in maintaining the mill operating. If air tube 38 should break the pressure air supply would fail, and check valve 67 in that tube would close to keep dirt out of the passage 63. However, since pressure air is on reservoir 26 the lubricant in tube 39 would continue to flow in bore 65 to the space 66 and upwardly past the bearing assembly 58 to force its way past the seal 68 which is a part of the seal assembly 56 previously identified. Loss of pressure air from line 38 drops pressure in the space outside seal 68 thereby allowing the pressure air in lubricant line 39 to pass seal 68 and create a secondary seal.

Air is delivered to conduit 33 from a compressor or plant air source (not shown). The pressure is maintained at about 15 psi, and an air flow measuring device 70 along with an air pressure gauge 71 and an alarm 72 are incorporated into the system. The alarm 72 sounds when an excessive air flow occurs. The air supply is conducted through the flexible coupler 31 and into column 28 where it is distributed to tubes 38 to maintain air seals in the roller assemblies 13. Air is delivered also into the reservoir 26 to act on the lubricant in tubes 39 and in the central tube 40.

OPERATION

In operation, the lubricant and pressure air supply systems function as follows: The container 35 being under pressure will deliver lubricant into the system of tubes 39 and passages 39A and 40. This lubricant travels through the conduit 34 inside of the air inlet pipe 33 and ultimately squirts under pressure and gravity into the distribution reservoir 26. The lubricant will then fill the pockets 44 and 45 of the distribution reservoir 26 somewhat evenly due to the cutaway surfaces 43, except that the pocket 45 connected by passages 39A, 40 and 40A will always empty itself into the reservoir 18 below, both due to gravity and air pressure.

It can now be seen that the roller support journal 52 operates under a constant head of lubricant which enters through the center passage 65 and enters the space inside the rotating sleeve 57. Seal 68 is provided at the top bearing 58 of the journal with the lip pointing outward (up) so that if for some reason excess pressure were to develop, the seals would vent lubricant or pressure air without causing rupture. Normally, however, there is no leakage at this point because of equal pressure across the seal 68 from lines 38 and 39. Under that condition, and should expansion of the lubricant take place, due to heat developed during operation, such lubricant is free to expand back into the distribution reservoir 26 and overflow down to the reservoir 18 by way of passages 39A, 40 and 40A.

It should also be noted that the lubricant distribution reservoir 26 is pressurized and therefore all distribution tubes or conduits 39, 39A, 40 and 40A are under 15 psi pressure, thereby assuring the flow of lubricant through each line. Should air pressure fail, lubricant will still distribute by the centrifugal force developed due to rotational speeds (in excess of 100 rpm) of the distribution reservoir 26, and gravity.

In FIG. 1, there is shown in broken outline a modification on the supply of lubricant into conduit 34. The modified supply is furnished from a lubricant container 35A which is under pressure from the branch conduit 36A tapped into pressure air conduit 33. The container 35A has an outlet 34A intended for connection with conduit 34 if this modification is employed. Excess use of lubricant will be detected by float 74 and alarm 73. The foregoing modification requires that the lubricant outlet 37 extended through the column 28 have its end 37A lengthened so it projects into the lubricant in reservoir 26 so that pressure air in container 35A will be off-set by pressure air in the reservoir 26. Thus, lubricant from container 35A will flow by gravity when the container 35A is supported above the elevation of the reservoir.

In the event of a lubricant line failure, detection is immediate because the lubricant will be blown out of the affected pocket in distribution reservoir 26. After expelling the lubricant, air is then free to escape thus increasing the flow of air. This increase will be detected by the flow responsive device 70 and alarm 72 will sound. The same function will take place if an air tube 38 breaks.

The breaking of an air tube 38 at either roller assembly 13 will allow the check valve 67 to close to keep out dirt. That event will eliminate the primary air seal, but lubricant will be forced under air pressure in bore 65, past a check valve 69 at plug 64, to lubricant bearings 58 and 59 and the air will then flow out at the space adjacent shoulder 55A formerly supplied with air from the conduit 38.

From the foregoing details of disclosure, it should be evident that the present embodiment is unique in combining an air seal and lubricant system for a material pulverizer in which a drive shaft supports a rotary member having pivotally connected journals with lower and upper bearings for mounting material pulverizing roller means, and lubricant seal means adjacent the upper bearings, such that the system comprised air distribution means carried by the drive shaft and a source of air under pressure supplied to the air distribution means, lubricant distribution means also carried by the drive shaft and supplied with lubricant from a suitable source. The preferred system includes air flow conducting means extending between the air distribution means and the lubricant seal means adjacent the upper bearings for maintaining a flow of air at the lubricant seal means for excluding abrasive material therefrom, lubricant flow conducting means between the lubricant distribution means and the pivotally connected journals for lubricating the lower and upper bearings, means connecting the air distribution and lubricant distribution means for applying pressure air upon the lubricant to assist in distributing the lubricant to the lower and upper bearings, air flow responsive means in the source of air under pressure, and means connected to the air flow responsive means to signal an air flow variation from a predetermined flow for signalling an interruption in the lubricant distribution to the lower and upper bearings.

What has been described above is a system which allows quick detection of lubrication failure on the bearings in the grinding roll assemblies, something which has not heretofore been available. This avoids operating the mill until damage has been done because now there is means outside the mill which detects the type of events which occur within the mill to cause expensive repairs to arise. It is further disclosed that the loss of the primary air seal at a grinding roll assembly is not too serious as the delivery of pressure air into the lubricant reservoir allows such lubricant and air to pass along the normal passages for lubricant, the air escaping past the lubricant seal to set up a secondary air seal in the zone where the primary air had created a primary air seal. In the system set forth a single coupling 31 allows both air under pressure and lubricant to be delivered into the mill, thereby reducing the need for a lubricant union. On the other hand, if a lubricant flow line should break, the increase in flow of pressure air will be detected almost immediately so the mill can be shut down before serious damage can take place.

While a presently preferred embodiment has been set forth and variously defined in the specification, it should be understood that some changes and modifications in the assembly of components may come to mind without substantially departing from the functions to be carried out by the components as set forth herein.

What is claimed is:

1. In an air seal and lubrication supply system for a grinding roll assembly having a pivot support by which a grinding roll is mounted, the improvement comprising:

(a) a journal shaft non-rotatably mounted in the pivot support;

(b) a sleeve surrounding and spaced from said journal shaft, said sleeve having an open end spaced from the pivot support forming a joint space therewith;

(c) bearing means engaged between said sleeve and journal shaft;

(d) a grinding roll carried by said sleeve for rotating with said sleeve relative to said journal shaft;

(e) means for delivering lubricant through said journal shaft to said bearing means in said sleeve;

(f) means for delivering air through the pivot support for creating an air seal between said sleeve and said journal shaft at said joint space between said sleeve open end and the pivot support; and (g) seal means in said sleeve in operative engagement with said journal shaft, said seal means being responsive to the delivery of air into said joint space for maintaining said seal means operative to retain lubricant in said sleeve.

2. In an air seal and lubrication system for a roller grinding mill having a drive shaft, a frame supported on the drive shaft, grinding roll assemblies pivotally suspended by journals from the frame, and bearings operatively supporting the journals, the improvement comprising:

(a) reservoir means for receiving lubricant and operably mounted for rotation with the drive shaft;

(b) conduit means connected between said reservoir means and the journals for directing lubricant to the bearings supporting the journals;

(c) pressure air receiving means connected to said reservoir means for rotation with the drive shaft, said pressure air receiving means having air distributing connections directly into the journals for establishing primary air seals to exclude dirt from the bearings supporting the journals, and said pressure air receiving means having a further connection with said lubricant reservoir means for subjecting the lubricant in said conduit means to pressure; and (d) separate lubricant and pressure air sources connected into said respective lubricant reservoir means and pressure air receiving means.

3. The improvement set forth in claim 2 wherein said conduit means for directing lubricant flow and air distributing connections are separate, whereby loss of the pressure air for establishing said primary air seals upon interruption of the air distributing connections from said pressure air receiving means is replaced by substantial use of the pressure air applied to the lubricant in said reservoir means for establishing secondary air seals to replace said primary air seals.

4. The improvement set forth in claim 2 wherein means for detecting air flow above a predetermined volume is connected into the pressure air supply, said detecting means providing a warning of pressure air as well as lubricant delivery malfunction.

5. In an air seal and lubrication system for a roller grinding mill having a grinding roll support frame, a drive shaft connected to the support frame, a non-rotatable journal pivoted on the support frame, and a grinding roll supporting sleeve having an interior space adapted to carry bearings between the journal and the interior of the sleeve, the improvement comprising:

(a) lubricant flow passage means in the non-rotatable journal open to the interior of the grinding roll support sleeve;

(b) a source of lubricant connected into said lubricant flow passage means for supplying the bearings with lubricant;

(c) seal means between the journal and grinding roll support sleeve for retaining the lubricant within said support sleeve; and (d) a source of pressure air having a first connection into the grinding roll support frame adjacent said seal means, and a second connection into said lubricant source, said first connection providing a primary air seal adjacent said seal means and said second connection supplying pressure air with the lubricant for providing a secondary seal from within said support sleeve upon loss of pressure air for said primary air seal.

6. The improvement set forth in claim 5 wherein rotation of said grinding roll support sleeve relative to the non-rotatable journal maintains lubricant in the bearings by centrifugal action of said sleeve.

7. The improvement set forth in claim 5 wherein means is connected into said source of pressure air for monitoring the flow of pressure air, and other means is connected to said monitoring means for detecting an increase in pressure air flow above a predetermined amount indicative of maintenance of lubricant for the bearings and said primary air seal.

8. The improvement set forth in claim 5 wherein lubricant reservoir means is carried by the grinding roll support frame to rotate therewith, said source of lubricant is connected into said reservoir, and said source of pressure air is connected into said reservoir.

* * * * *